US007121980B2

(12) United States Patent
Chen

(10) Patent No.: US 7,121,980 B2
(45) Date of Patent: Oct. 17, 2006

(54) LINEAR MAGNETIC DAMPER

(76) Inventor: James Chen, No. 35, Tun Hi Rd., Chin Chan Li Sa Lu Chen, Taichung Hsien (TW)

( * ) Notice: Subject to any disclaimer, the term of this patent is extended or adjusted under 35 U.S.C. 154(b) by 253 days.

(21) Appl. No.: 10/900,227

(22) Filed: Jul. 28, 2004

(65) Prior Publication Data

US 2005/0176560 A1 Aug. 11, 2005

(30) Foreign Application Priority Data

Feb. 9, 2004 (TW) ..... 93201810 U

(51) Int. Cl.
*A63B 21/00* (2006.01)
*A63B 22/00* (2006.01)

(52) U.S. Cl. ..... 482/1; 482/8; 482/9; 482/5; 482/903

(58) Field of Classification Search ..... 482/1–9, 482/91–108, 114, 133, 900, 903, 135
See application file for complete search history.

(56) References Cited

U.S. PATENT DOCUMENTS 5,711,749 A * 1/1998 Miller ..... 482/135
6,027,429 A * 2/2000 Daniels ..... 482/5
6,896,643 B1 * 5/2005 Durfee, Jr. ..... 482/100

* cited by examiner

*Primary Examiner*—Glenn Richman
(74) *Attorney, Agent, or Firm*—Browdy and Neimark, PLLC

(57) ABSTRACT

A linear magnetic damper includes a magnetically attractive rail, a damper body movable along the magnetically attractive rail and having a longitudinal passage, which accommodates the magnetically attractive rail, and having a plurality of openings symmetrically formed at two sides thereof and respectively arranged in alignment, and a plurality of magnetic members respectively mounted in the openings at two sides of the damper body for applying a magnetic force to the magnetically attractive rail.

6 Claims, 6 Drawing Sheets

LINEAR MAGNETIC DAMPER

BACKGROUND OF THE INVENTION

1. Field of the Invention

The present invention relates to a damper for use in an exercising apparatus and more particularly, to a linear magnetic damper.

2. Description of the Related Art

FIG. 1 illustrates a conventional exerciser, which is comprised of a framework 2, a lifting mechanism 3 mounted on the framework 2, a plurality of pulleys 5, a weight set 6, and a cord member 4 running on the pulleys 5 and connected between the lifting mechanism 3 and the weight set 6. When lifting the lifting mechanism 3, the weight set 6 generates a counter force (resistance) against the user. Because the weight set 6 includes a plurality of heavy metal members, these have metal members may hit against one another to produce much noise during operation of the exerciser (more particularly during down stroke of the weight set 6, thereby annoying the user. It is also dangerous when the weight set 6 falls to generate great impact. Further, because the lifting mechanism is operated to fight against the gravity of the weight set, the weight set must be arranged to move along a vertical path, i.e., there is a limitation to the installation orientation of the weight set.

SUMMARY OF THE INVENTION

The present invention has been accomplished under the circumstances in view. It is therefore the main object of the present invention to provide a linear magnetic damper, which can effectively reduce the noise produced during its operation. It is another object of the present invention to provide a linear magnetic damper, which is safe for operation and free from the limitation of installation orientation. To achieve the foregoing objects of the present invention, the magnetic damper is comprised of a magnetically attractive rail, a damper body movable along the magnetically attractive rail and having a longitudinal passage extending through two distal ends thereof for accommodating the magnetically attractive rail, and a plurality of openings symmetrically formed at two sides thereof and respectively in alignment, and a plurality of magnetic members respectively mounted in openings formed at two sides of the damper body for generating a magnetic force attracting the magnetically attractive rail as resistance for exercise. Because the magnetic members generate a magnetic force to attract the magnetically attractive rail, the linear magnetic damper can reduce the noise produced while impact is generated during the operation of an exercise and can be installed in the exerciser in any desired direction.

DETAILED DESCRIPTION OF THE INVENTION

Figure 1:
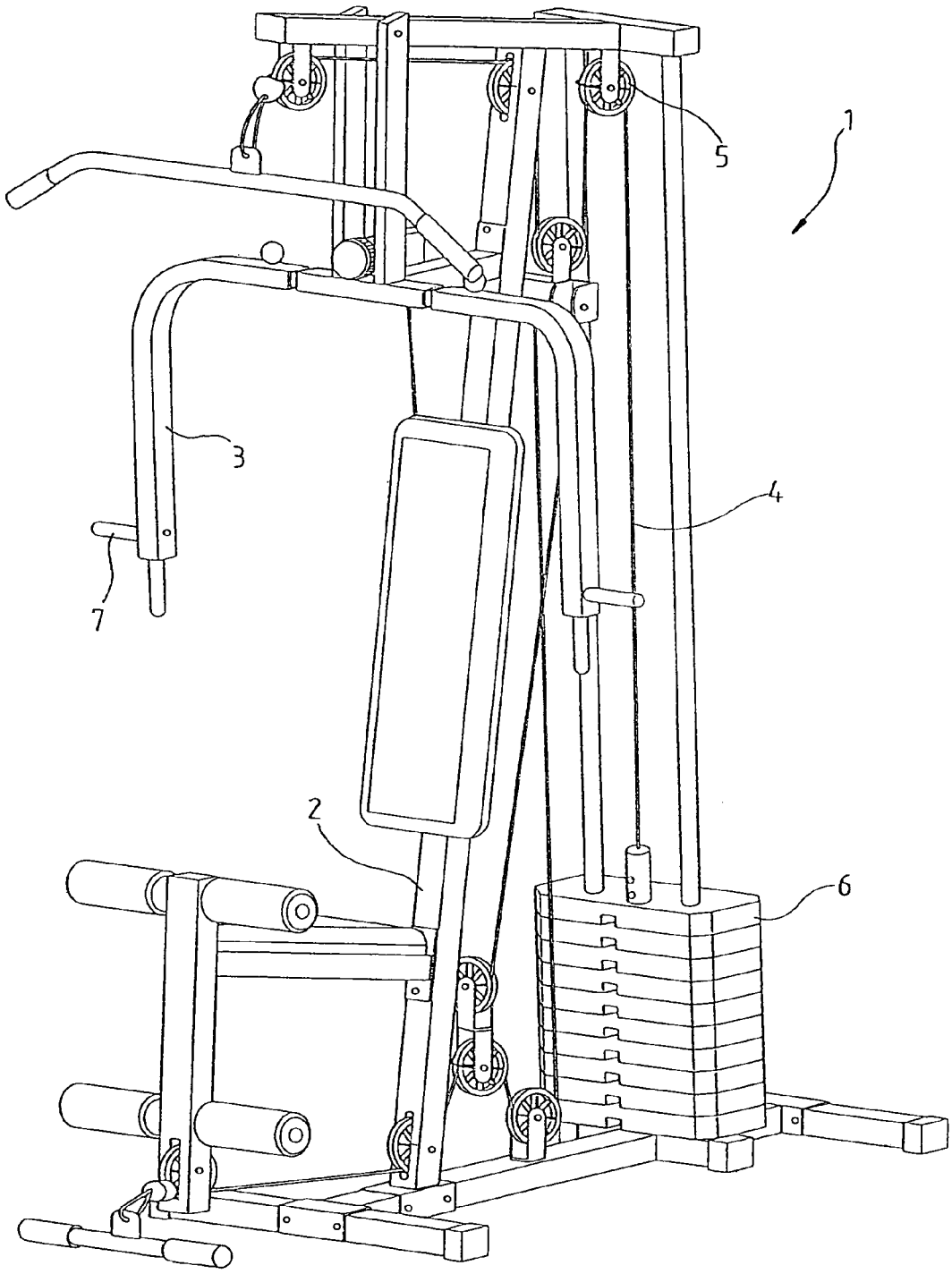
FIG. 1 PRIOR ART
FIG. 1 is a perspective view of a conventional exerciser.
Figure 2:
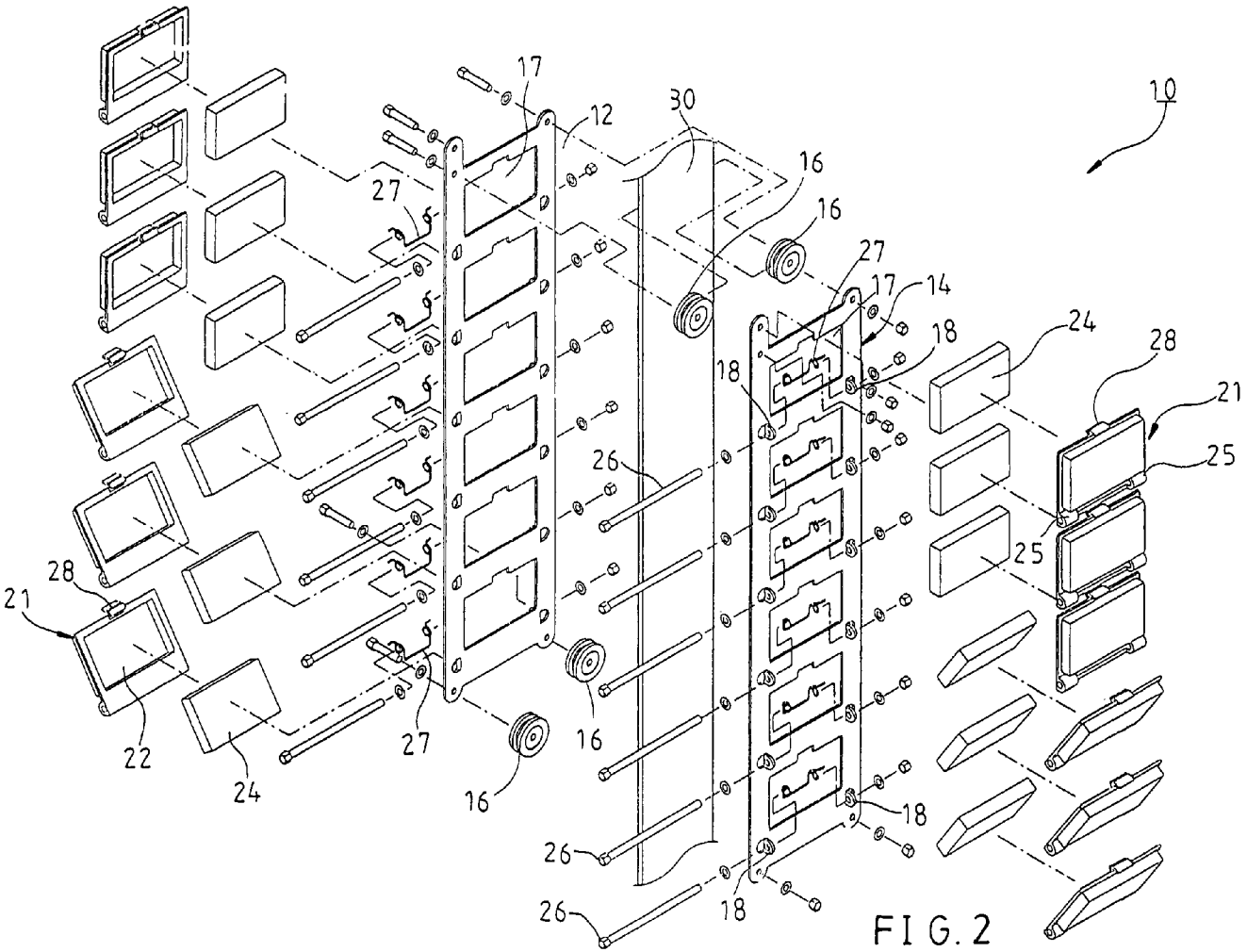
FIG. 2 is an exploded view of a linear magnetic damper according to a first preferred embodiment of the present invention.
Figure 3:
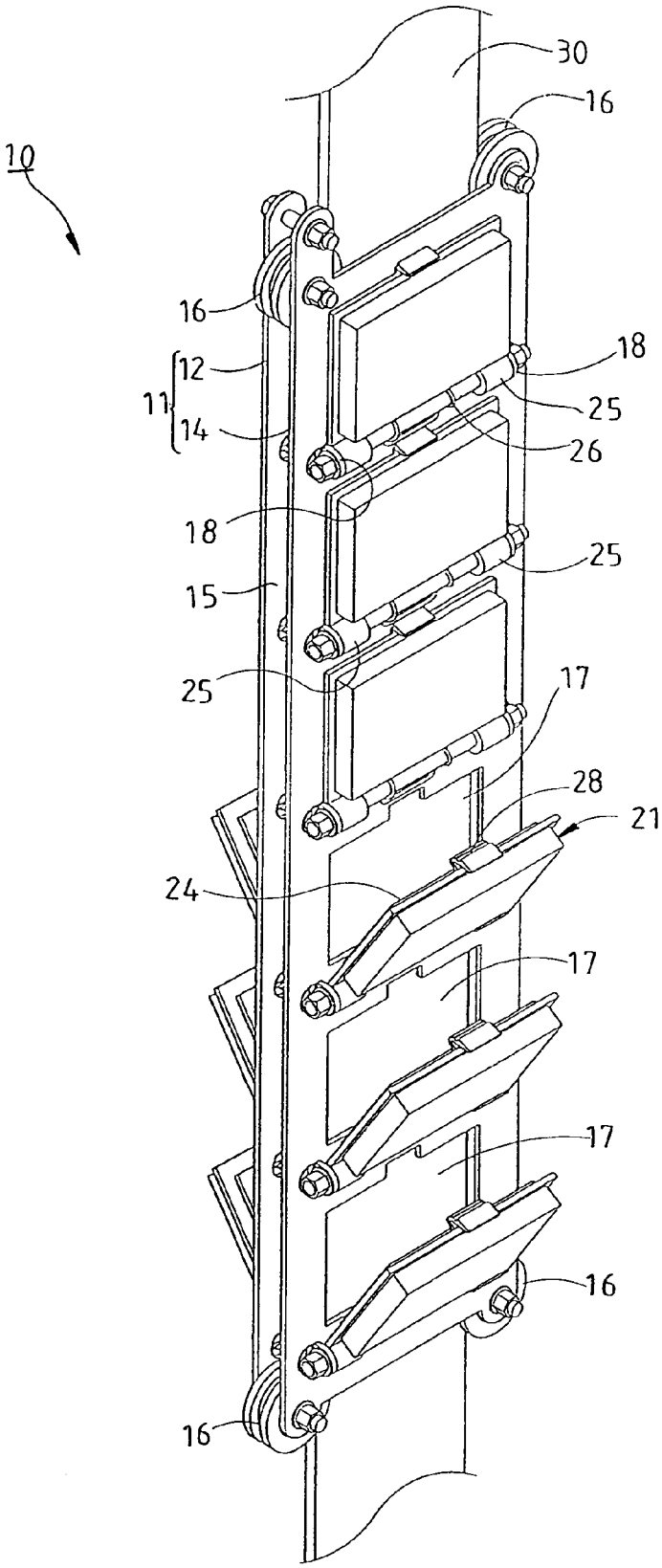
FIG. 3 is a perspective view of the linear magnetic damper according to the first preferred embodiment of the present invention.

Referring to FIGS. 2 and 3, a linear magnetic damper 10 is mounted on a magnetically attractive sliding rail 30, which runs through linear magnetic damper 10. The linear magnetic damper 10 is comprised of a damper body 11 and a plurality of magnet holders 21.

The damper body 11 includes two symmetrical thin elongated plate members 12, 14 that are fastened together and defines a longitudinal passage 15 therebetween, through which the sliding rail 30 extends, and four pulleys 16 respectively pivotally mounted at four corners of the longitudinal passage 15 and respectively coupled to the two opposite long sides of the sliding rail 30 to guide linear movement of the damper body 11 along the sliding rail 30. The plate members 12, 14 each include a plurality of openings 17 arranged in alignment, and pairs of eye lug 18 respectively bilaterally formed in alignment under each opening 17.

The magnet holders 21 are respectively coupled to the plate members 12, 14 corresponding to the openings 17, each having a recess 22, a magnet 24 fixedly mounted in the recess 22 for generating a magnetic force to attract the sliding rail 30 during linear motion of the magnetic damper 10, and two pivot lugs 25 bilaterally formed at a bottom side thereof and respectively pivotally coupled to the eye lugs 18 at the plate members 12, 14 by a respective pin 26. A torsion spring 27 is respectively mounted on the pin 26 at each magnet holder 21 and stopped between the respective magnet holder 21 and the plate member 12(14) to support the respective magnet holder 21 in an outwardly tilted position spaced from the corresponding opening 17. Each magnet holder 21 further includes a hook-like springy retaining block 28 provided at a top side thereof. While pushing one magnet holder 21 toward the corresponding opening 17, the retaining block 28 is forced into engagement with a peripheral wall of the corresponding opening 17 to secure the respective magnet holder 21 to the corresponding opening 17. At this time, the magnet holder 21 seals the corresponding opening 17 to be held in an operative position to generate a magnetic force to attract the sliding rail 30 and to further provide the resistance for the exercise.

Figure 4:
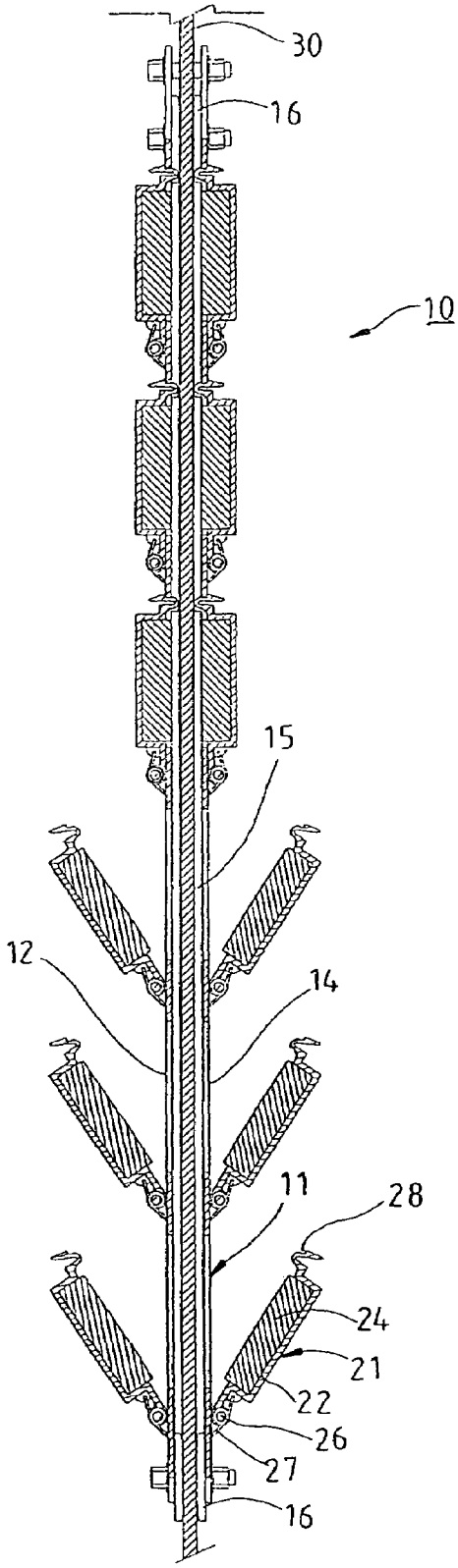
FIG. 4 is a sectional view of the linear magnetic damper at work according to the first embodiment of the present invention.

Referring to FIG. 4, because the magnet holders 21 are respectively pivoted to the damper body 11, the user can optionally set the magnet holders 21 between the operative position, in which the corresponding openings 17 are sealed, and a non-operative position, in which the corresponding openings 17 are unsealed, to adjust the total damping resistance. While turning one magnet holder 21 outwards to disengage the respective retaining block 28 from the peripheral wall of the corresponding opening 17, the respective torsion spring 27 immediately pushes the magnet holder 21 outwards from the operative position to the non-operative (open) position. By means of the pulleys 16, the linear magnetic damper 10 can be smoothly moved along the magnetically attractive sliding rail 30 up and down to impart the magnetic force to the magnetically attractive sliding rail 30 without producing noise. Because the magnetic force generates the damping resistance, the linear magnetic damper can be installed in an exerciser in any desired direction by means of the magnetically attractive sliding rail.

Figure 5:
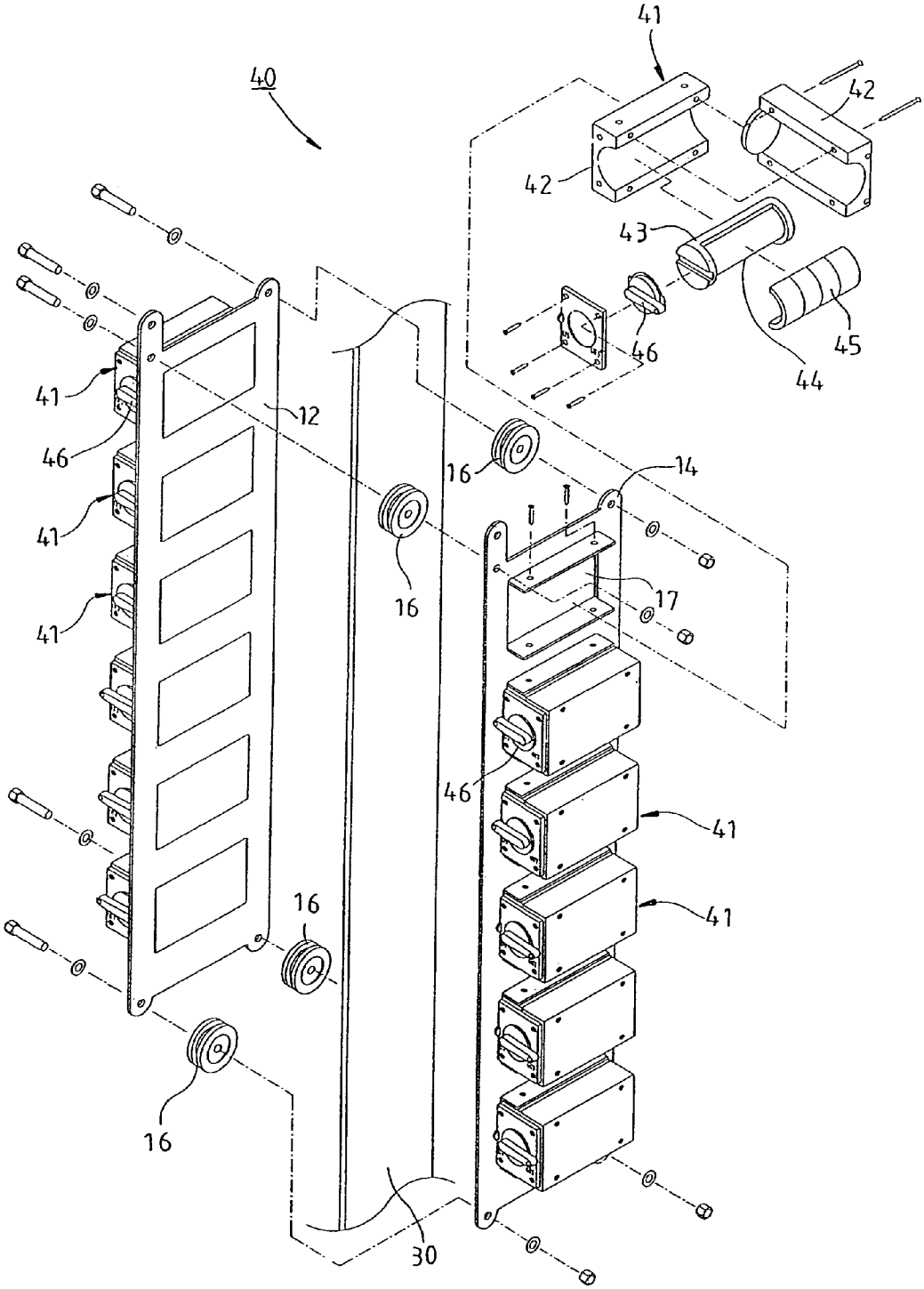
FIG. 5 is an exploded view of the linear magnetic damper according to a second preferred embodiment of the present invention.
Figure 6:
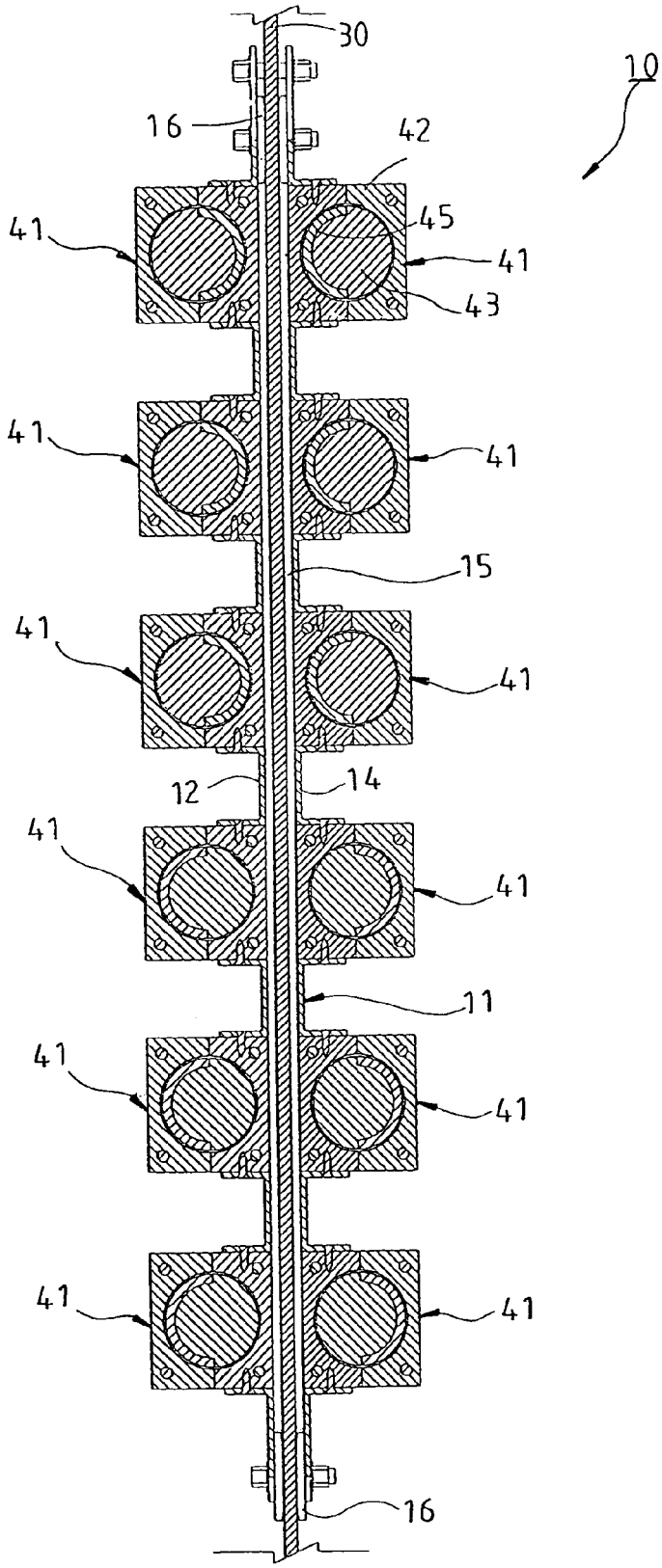
FIG. 6 is a sectional view of the linear magnetic damper at work according to the second embodiment of the present invention.

Referring to FIGS. 5 and 6, each magnet holder 41 of the linear magnetic damper 40 constructed according to a second preferred embodiment of the present invention includes a housing 42 fixedly mounted to one opening 17, a shaft 43 mounted in the housing 42 and having a longitudinal groove 44 in one half surface thereof, a plurality of arched magnets 45 mounted to the longitudinal groove 44 of the shaft 43, and a knob 46 fastened to an end of the shaft 43 and disposed outside the housing 42 for turning by the user to rotate the shaft 43 to shift the magnets 45 between two opposite positions, namely, the operative position where the magnets 45 face the magnetically attractive sliding rail 30 and impart a magnetic force to the magnetically attractive sliding rail 30, and the non-operative position where the shaft 43 blocks the magnetic force to the magnetically attractive sliding rail 30.

Further, the aforesaid magnet of the magnetic member could alternatively be an electromagnet, which is wound around with a coil wound and electrically connected to a current control, The control current controls the supply of electric current to the coil to cause the electromagnet to produce a magnetic force. By means of controlling the current control to adjust the amount of electric current to the coil, the magnetic force of the electromagnet is relatively adjusted. Because this design of electromagnet is of the known art, no further detailed description in this regard is necessary.

What is claimed is:

1. A linear magnetic damper comprising:

a magnetically attractive rail;

a damper body movable along said magnetically attractive rail and having a longitudinal passage extending through two distal ends thereof for accommodating said magnetically attractive rail, and a plurality of openings symmetrically formed at two sides thereof and respectively arranged in alignment; and a plurality of magnetic members respectively mounted to said openings at two sides of said damper body for generating a magnetic force to said magnetically attractive rail, whereby a resistance is formed for exercise.

2. The linear magnetic damper as defined in claim 1, wherein said damper body comprises two plate members fastened together and having said longitudinal passage therebetween, and four pulleys respectively rotatably mounted between said two plate members at four corners of said longitudinal passage.

3. The linear magnetic damper as defined in claim 1, wherein said magnetic members each comprise a magnet holder, said magnet holder having a recess on its midsection and two eye lugs bilaterally disposed at a bottom side thereof, a pin mounted in said eye lugs to pivotally secure said magnet holder to said damper body under one said opening, a magnet fixedly mounted in said recess, and a torsion spring mounted on said pin for forcing said magnet holder to pivot away from the corresponding opening.

4. The linear magnetic damper as defined in claim 3, wherein said magnet holder further comprises a hook-like springy retaining block projected from a top side thereof for engaging the corresponding opening to further hold said magnet holder to seal the corresponding opening.

5. The linear magnetic damper as defined in claim 1, wherein said magnetic members each comprise a housing fastened to one opening of said damper body, a shaft rotatably mounted in said housing and having a longitudinal groove in one half periphery thereof, a plurality of arched magnets fixedly mounted in said longitudinal groove, and a knob fastened to an end of said shaft outside said housing for turning by the user to rotate said shaft.

6. The linear magnetic damper as defined in claim 1, wherein said magnetic members each comprise an electromagnet and a coil wound round said electromagnet, said coil being electrically connected to a current control, said current control controlling supply of electric current to said coil, whereby said resistance is adjustable by adjusting the amount the electric current.

* * * * *